United States Patent [19]

McCreary et al.

[11] 4,026,127

[45] May 31, 1977

[54] ROLL FEED FOR CIRCULAR KNITTING MACHINE

[76] Inventors: Marcus C. McCreary; William M. McCreary; Mary G. McCreary, all of Drawer A, Lexington, Ala. 35648

[22] Filed: Jan. 2, 1976

[21] Appl. No.: 646,000

[52] U.S. Cl. ..... 66/132 R; 226/183; 226/196

[51] Int. Cl.[2] ..... D04B 15/48

[58] Field of Search ..... 66/132 R, 125 R; 226/183, 196

[56] References Cited

UNITED STATES PATENTS

| | | | |
|---|---|---|---|
| 1,947,958 | 2/1934 | Welch et al. | 66/132 |
| 3,303,671 | 2/1967 | Oliver | 66/132 R |
| 3,511,062 | 5/1970 | Nogues | 66/132 R X |
| 3,690,535 | 9/1972 | Nakamichi | 229/196 X |
| 3,693,378 | 9/1972 | Nogues | 66/132 R X |
| 3,700,153 | 10/1972 | Delair et al. | 66/132 R |
| 3,806,018 | 4/1974 | Gebler et al. | 226/183 |

FOREIGN PATENTS OR APPLICATIONS

| | | | |
|---|---|---|---|
| 2,215,148 | 10/1972 | Germany | 66/132 R |

*Primary Examiner*—Mervin Stein
*Assistant Examiner*—A. M. Falik
*Attorney, Agent, or Firm*—Clarence A. O'Brien; Harvey B. Jacobson

[57] ABSTRACT

An attachment for a knitting machine in the form of a roll feed device to maintain an even yarn tension to the needles to provide a smooth fabric since the needles will always receive a constant tension yarn from the roll feed. The roll feed includes a bottom rubber covered roller and a top steel roller through which the yarn passes with upper and lower guide eyelets being provided for the yarn and the lower rubber covered roller being driven at a positive, adjustable speed directly from the ring gear on the bottom of the circular knitting machine cylinder. By maintaining constant tension on the yarn to the needles, a more uniform fabric is produced.

9 Claims, 6 Drawing Figures

Fig. 4
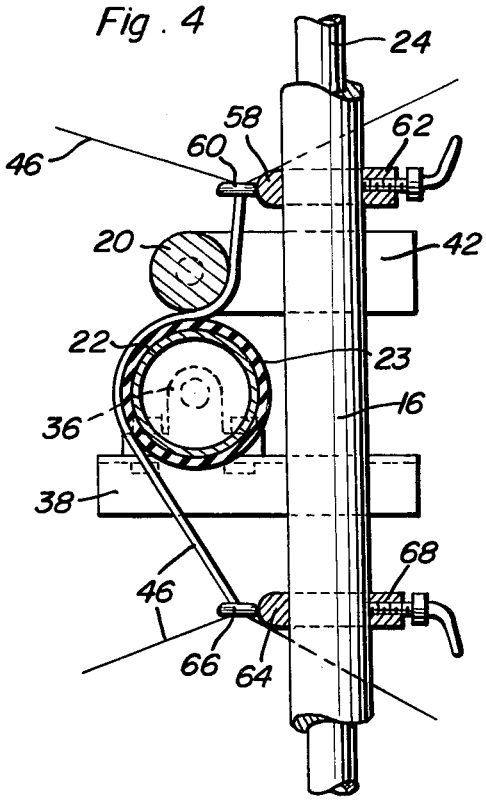
Fig. 6
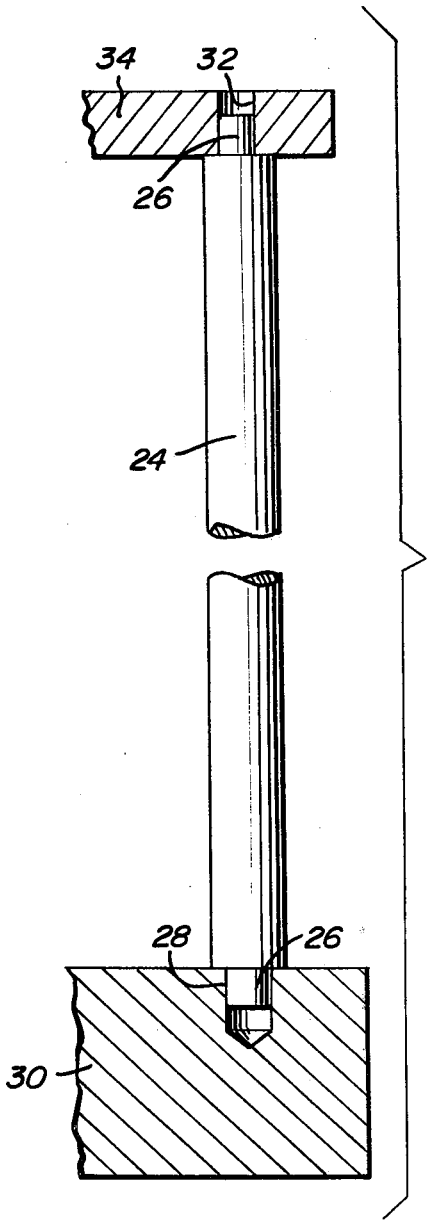
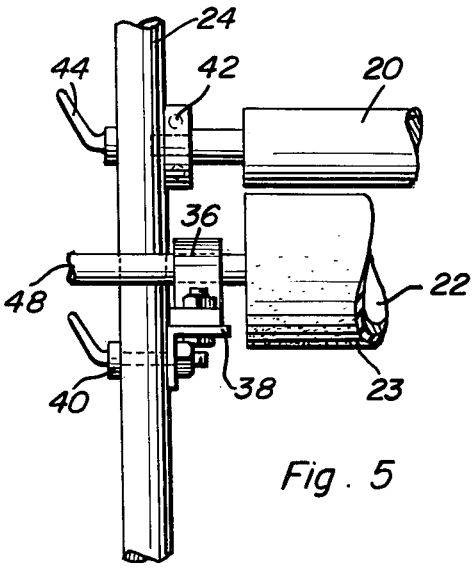
Fig. 5

ROLL FEED FOR CIRCULAR KNITTING MACHINE

BACKGROUND OF THE INVENTION

1. Field of the Invention

The present invention generally relates to circular knitting machines and more particularly a roll feed for such machines in which yarn being fed from supply cones to the needles is maintained under constant tension between the roll feed and needles.

2. Description of the Prior Art

The feeding of strands of yarn to the knitting mechanism in a knitting machine, such as a circular knitting machine, has presented substantial problems in view of the non-uniformity of the yarn on the supply cones. For example, if the yarn is too tightly wound on the cone, it sometimes is difficult to unwind and, in effect, sticks to the cones thus resulting in excessive tension in the strands between such sticking cones and the needle receiving the strand of yarn therefrom. In other instances, the yarn on the cone may be underwound so that too little tension exists in the strand between the cone and needle. Non-uniform tension in the yarn strands results in a non-uniform fabric. This problem has been recognized in the knitting industry and efforts have been made to solve the problem. One example of such efforts is disclosed in prior U.S. Pat. No. 3,243,974, issued Apr. 5, 1966, in which a pair of side-by-side rollers receive the yarn strands therebetween with one of the rollers being spring biased toward the other in an effort to exert tension on the yarn strands which pass between the rollers to the needles. Other prior patents relating to this invention are U.S. Pat. Nos.:

424,295 filed on Mar. 25, 1890;
1,947,958 filed on Feb. 20, 1934;
2,111,984 filed on Mar. 22, 1938;
3,080,837 filed on Mar. 12, 1963;
3,693,378 filed on Sept. 26,1972.

While such previous devices have operated with some degree of success, uneven yarn tension remains a problem in circular knitting machines even when conventional tape feed arrangements are employed or arrangements such as disclosed in the prior patents are employed.

SUMMARY OF THE INVENTION

An object of the present invention is to provide a roll feed for circular knitting machines which will maintain a substantially constant and equal tension on all strands of yarn being "consumed" by the knitting needles with the roll feed incorporating a pair of rollers oriented in horizontal position with a bottom roller being covered with rubber and an upper roller being constructed of steel, the lower roller being driven at a positive, adjustable speed by a direct driving connection with the ring gear on the bottom of the cylinder of the knitting machine.

Another object of the invention is to provide a roll feed for circular knitting machines in accordance with the preceding object which is quite simple in construction, provided with a minimum number of moving parts such resulting in less maintenance, repair bills, down time and more production per machine and which can be easily installed on most circular knitting machines with very little modification thereof.

Still another object of the invention is to provide a roll feed for circular knitting machines having a quick change stitch setting which utilizes only a single take-up adjustment with the roll feed extending the full width of the cylinder thus providing sufficient room for each yarn across the width of the cylinder.

A further object of the present invention is to provide a roll feed in accordance with the preceding objects in which the steel roller on top of the rubber covered roller provides an even nip pressure on the rubber roller due to the weight of the steel roller rather than by spring tension which can become maladjusted or ineffective.

Still another important object of the present invention is to provide a roll feed in accordance with the preceding objects in which the rubber roller is of a larger diameter than the overlying steel roller which prevents wax buildup from the yarn onto the rubber roller which occurs due to excessive pressure between the rollers, such absence of wax buildup resulting from the difference in materials and the larger diameter of the rubber roller with the positive feed between the rollers being accomplished by less pressure at the nip point and more wrap around or surface contact with the rubber roller.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 4 is a transverse, sectional view of the roll feed illustrating the orientation of the rollers and eyelets for guiding the yarn strands in relation to the rollers.

FIG. 5 is a fragmental elevational view of the ends of the rollers.

FIG. 6 is a fragmental view of the manner in which the supporting members are attached to the knitting machine.

DESCRIPTION OF THE PREFERRED EMBODIMENTS

Figure 1:
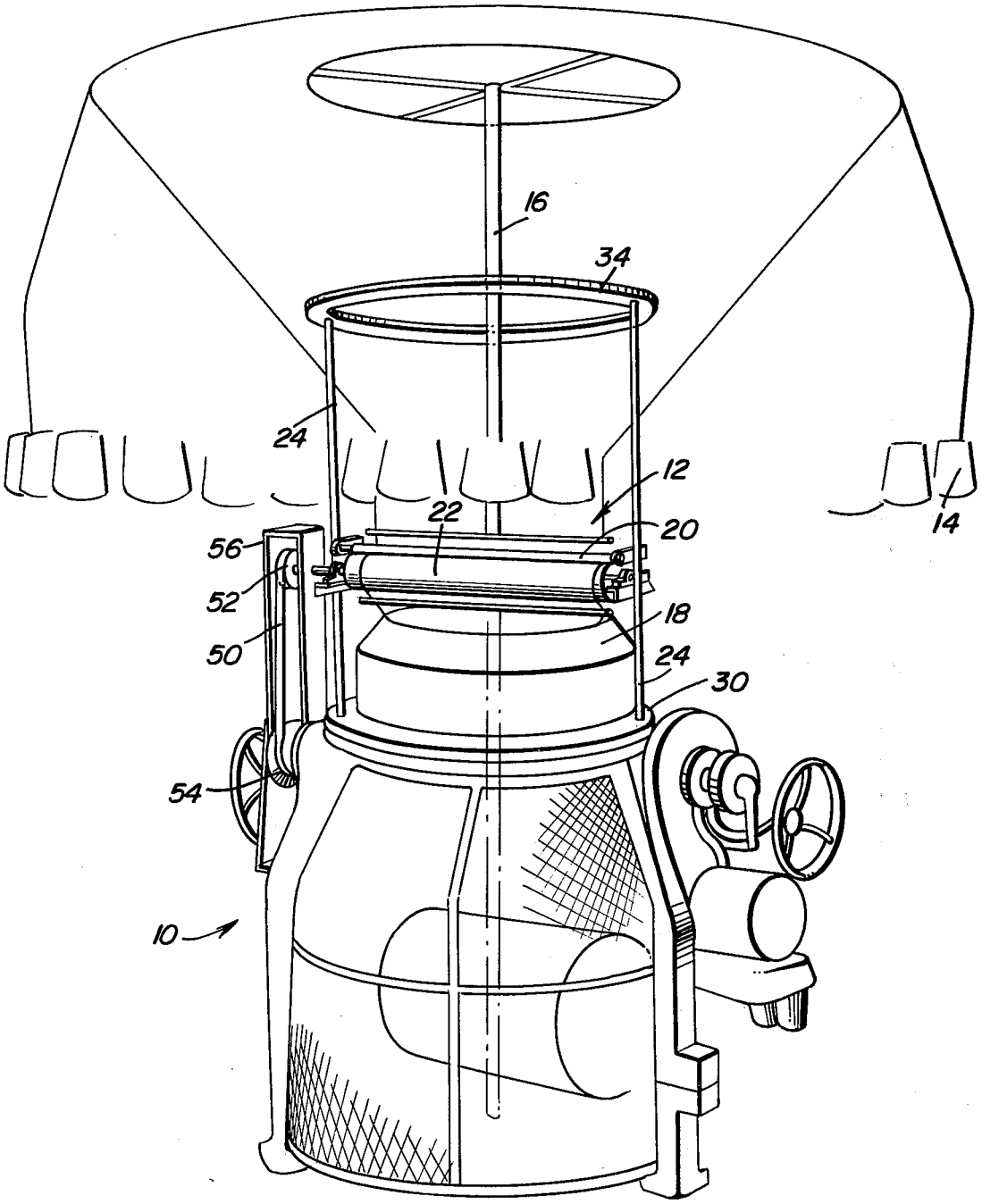
FIG. 1 is a diagrammatic perspective view of a circular knitting machine with the roll feed of the present invention incorporated thereon.

FIG. 1 illustrates diagrammatically a conventional, circular knitting machine 10 provided with the roll feed 12 of the present invention incorporated thereon. The knitting machine 10 includes yarn supply cones 14 mounted on the usual pins on a supporting structure supported by a vertical post 16. The knitting machine includes various guides and the like for the yarn strands which are removed from the individual cones 14 and are guided downwardly into the needle cylinder 18 which is rotated by a conventional motor drive unit and appropriate gearing including a ring gear (not shown). The circular knitting machine is conventional and the elements of the knitting machine previously recited are recognized by those skilled in the art and are commonly found in conventional circular knitting machines of the rotating needle cylinder type such as in U.S. Pat. No. 3,243,974 and 3,303,671.

Figure 2:
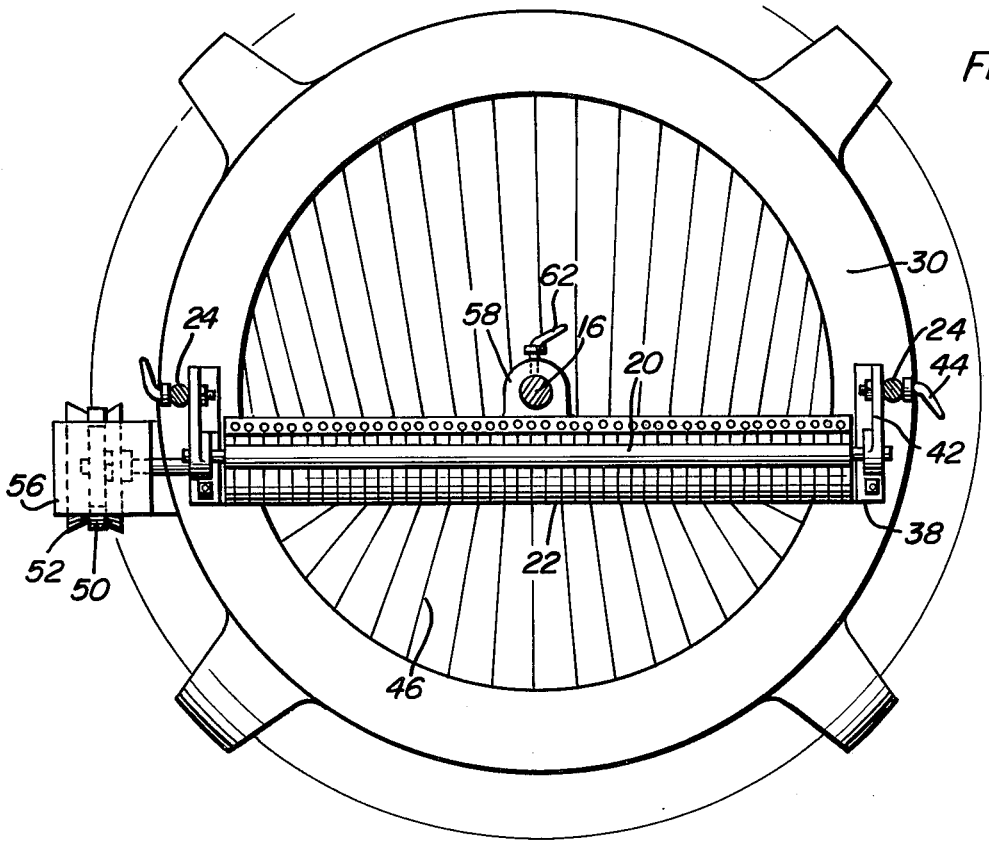
FIG. 2 is a plan view of the roll feed attachment of the present invention illustrating the slightly eccentric relationship of the roll feed to the cylinder.
Figure 3:
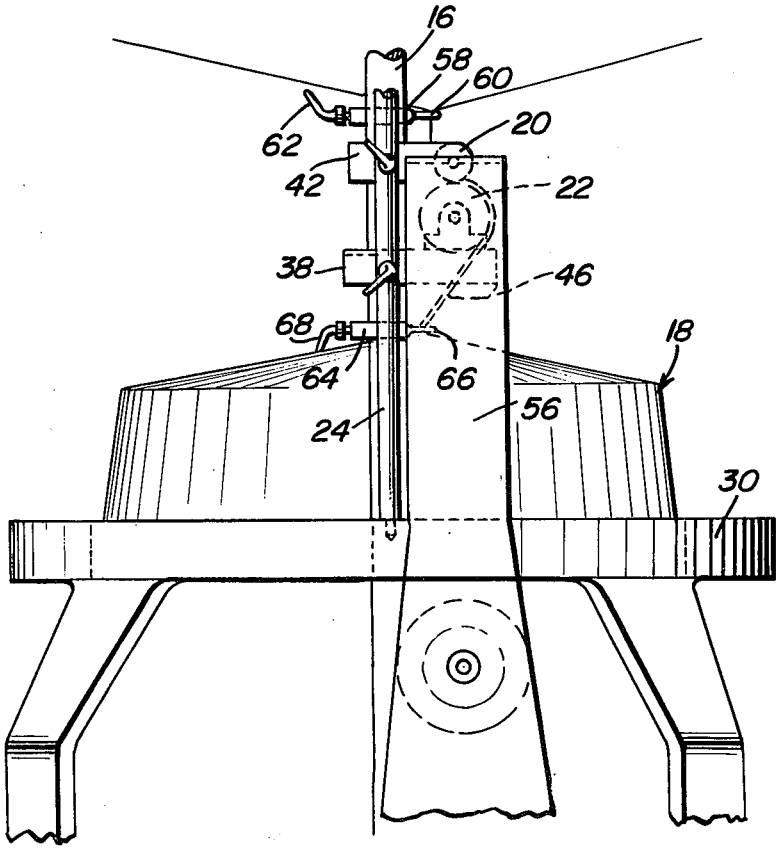
FIG. 3 is a side elevational view of the construction of FIG. 2.

The roll feed 12 of the present invention includes a pair of vertically superimposed rollers including a top cylindrical roller 20 constructed of steel and a larger diameter cylindrical lower roller 22 having a rubber covering 23 thereon. The axes of the rollers 20 and 22 are aligned with each other and the rubber covered roller 22 is substantially larger in diameter than the steel roller 20 as illustrated in FIG. 4. For supporting the roll feed 12, a pair of vertical posts 24 are provided which are oriented approximately 3 inches laterally of the center of the machine as illustrated in FIG. 2 so that the rollers will pass by the center post 16 which holds the conventional cloth spreader and air device. Each post 24 includes a reduced lower and upper end 26 with the lower end being received in a socket or recess 28 formed in the needle cylinder base 30 with the upper end of each post 24 being received in a recess or hole 32 in the creel ring 34, thus fixedly securing the vertical posts between the machine base and creel ring casting with the weight of the creel ring being sufficient to hold the posts in positive position.

The bottom roller 22 is rotatably supported by pillow bearing blocks 36 supported by bracket structures 38 adjustably secured to the vertical post 24 by a clamp bracket 40. The steel roller 20 is supported by a flange bearing 42 on each end thereof by a bracket structure 44 secured to the post 24 with the flange bearing structure 42 enabling free floating movement of the roller 20 toward the roller 22 so that the weight of the roller 20 will exert the nip pressure on the yarn strands 46 which pass under the top roller 20 and over and around the outside of the bottom roller 22 as illustrated in FIG. 4.

The lower roller 22 includes a shaft 48 received in the pillow block bearings 36 with one end of the shaft 48 being driven by a V-belt 50 and a V-belt pulley 52 mounted on the end of the shaft 48. The V-belt 50 is in driving engagement with a drive pulley 54 driven from the ring gear on the knitting machine to provide a positive drive for the roller 22. The upper pulley 52 is a variable speed pulley and a variable speed adjustment mechanism is associated with the drive belt 50 in order to vary the speed of the rubber covered roller 22 in relation to the main gear. The very speed pulley mechanism is conventional and enables adjustment in the rotational speed of the pulley 52 in relation to the drive pulley 54. A suitable housing 56 is provided for the variable speed mechanism and the housing may be provided with a manual control knob for adjusting the speed of the lower roller 22 in a well known manner.

Mounted above the top roller 20 is an upper eyelet strip 58 having a plurality of equally spaced eyelets 60 therein with the eyelet strip 58 being secured to the center post 16 by a clamp device 62. Mounted below the lower roller 22 is a lower eyelet strip 64 having a plurality of eyelets 66 equally spaced along the length thereof and being adjustably secured in place on the center post 16 by a clamp device 68. The eyelet strips are parallel to the rollers and the number of eyelets is determined by the number of feeds on the machine with each eyelet receiving a single yarn being fed into the machine with the eyelets being spaced apart approximately ⅜ to ½ inch in order to separate the yarns being fed between the rollers 20 and 22. The clamp mechanisms enable the eyelet strips to be vertically adjusted by loosening the set screw and raising or lowering the encircling ring on the center post 16. As illustrated, the upper eyelet strip is offset 2-½ to 3 inches to the nip point of the rubber roller and steel roller which, combined with the position of the lower eyelet strip provides approximately a 50% friction wrap around of the yarn on the rubber roller 22. The yarn from the lower eyelet strip is fed to the stop motions or directly to yarn guides on the cylinder 18 whichever is preferable.

The roll feed of the present invention can be applied to almost any circular knitting machine and due to the simplicity of the device and the knitting problems which it helps to eliminate, less experienced knitting machine operators can knit top quality fabric since each yarn is evenly fed through the rollers to the needles with the same tension resulting in smooth, uniform knitted fabric. The stitch can be changed quickly with a simple knob adjustment and the roll feed will maintain the stitch without variance until the operator changes it. Pulls on the yarn resulting from yarn sticking to the cone or being underwound will not affect the appearance of the fabric because the tension remains the same between the rollers and needles when the roll feed of the present invention is used. Since the roll feed of the present invention utilizes a minimum number of parts and is of heavy duty construction, less service and less down time will occur. Further, no tapes such as employed in a conventional tape feed need to be replaced or repaired and no wax buildup will occur. In addition, there is no chance of running light ends in the fabric due to the tape being down or running in and out and the roll feed provides a greater range of stitches being otained before changing the cylinder height. These and other factors contribute to a better quality fabric and materially simplifies operation of the knitting machine and enables the operator of the knitting machine to more easily observe the yarn and rethreading time caused by yarn breakage will be greatly reduced.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A roll feed for a circular knitting machine of the type having a needle cylinder receiving a plurality of yarn strands for supply cones, said roll feed comprising a pair of parallel rollers rotatably supported about horizontal axes with one roller being disposed above the other and in peripheral contact with the lower roller, yarn strand guide means disposed above the upper roller for guiding strands of yarn downwardly into the nip between the roller, yarn strand guide means disposed below the lower roller and guiding strands of yarn from the roll feed to knitting needles on the machine, and drive means connected to the lower roller for driving the lower roller at a positive speed to maintain constant yarn tension between the roll feed and needles, said lower roller being provided with a friction producing surface on the periphery thereof, said upper roller being floatingly mounted whereby the weight of the upper roller will exert nip pressure against the lower roller for maintaining frictional warp around contact between the yarn strands and the lower roller, said friction surface on the lower roller being rubber external surface to increase frictional contact between the lower roller and the yarn strands, said upper roller being a steel roller having a diameter substantially less than the diameter of the rubber covered lower roller, said drive means for the lower roller including means for varying the speed of the lower roller to vary the tension of the yarn strands, said upper yarn strand guide means including a plurality of equally spaced eyelets disposed above the upper roller and spaced laterally thereof for guiding the individual yarn strands downwardly into the laterally facing nip between the upper and lower rollers, and means vertically adjustably supporting said eyelets for varying the position thereof.

2. The structure as defined in claim 1 wherein the lower yarn strand guide means includes a plurality of eyelets receiving individual yarn strands from the lower roller, said lower eyelets being positioned generally in vertical alignment with the rotational axes of the upper and lower rollers whereby the yarn strands engage approximately one-half of the peripheral surface of the rubber covered lower, larger roller.

3. The structure as defined in claim 2 wherein said rollers are supported in bearing assemblies, vertical posts at diametrically opposed points on the circular knitting machine for supporting said rollers, the upper roller having bracket structures mounted on the vertical posts to enable vertical movement thereof whereby the weight of the steel roller forms the sole means biasing the steel roller against the rubber covered roller.

4. The structure as defined in claim 3 wherein the vertical posts are provided with reduced ends adapted to be received in recesses in the creel ring needle cylinder base of the circular knitting machine for mounting the roll feed between the creel ring and needle cylinder base of the circular knitting machine.

5. The structure as defined in claim 4 wherein said upper and lower eyelet are mounted on strips adapted to be adjustably supported on a central vertical post providing a support for the circular knitting machine.

6. The structure as defined in claim 5 wherein said rollers are eccentrically arranged in relation to the center post on the circular knitting machine and the bracket structure connecting the ends of the rollers to the vertical posts being laterally disposed for enabling the rollers to be positioned along side of the central vertical post in the circular knitting machine.

7. A roll device for maintaining predetermined tension on flexible elements being fed to a machine comprising a pair of horizontal rollers oriented in vertically superimposed relation with the lower roller being driven and the upper roller being floatingly supported whereby the weight of the upper roller will cause the upper roller to maintain contact with the lower roller, said lower roller including a friction surface thereon to frictionally engage flexible elements passing between the rollers, upper and lower guide means associated with the rollers to guide the flexible elements into the nip point between the rollers and to retain the flexible elements in substantial wrap around, friction contact with the lower roller whereby the friction surface on the lower roller will exert a predetermined drag on the flexible elements passing around a substantial portion of the periphery of the lower roller, said friction surface on the lower roller being in the form of a coating of resilient material thereon, said upper roller having a substantially smooth peripheral surface and being constructed with sufficient weight to retain frictional contact between the flexible elements and the lower roller, said roll feed device adapted to be used on a circular knitting machine of the type having a creel ring with yarn supply cones located above a needle cylinder with the flexible elements being in the form of yarn strands passing from the plurality of supply cones on the creel ring to the needle cylinder on the circular knitting machine.

8. A roll feed for a circular knitting machine of the type having a needle cylinder receiving a plurality of yarn strands from supply cones, said roll reed comprising a pair of parallel rollers rotatably supported about horizontal axes with one roller being disposed above the other and in peripheral contact with the lower roller, yarn strand guide means disposed above the upper roller for guiding strands of yarn downwardly into the nip between the rollers, yarn strand guide means disposed below the lower roller and guiding strands of yarn from the roll feed to knitting needles on the machine, and drive means connected to the lower roller for driving the lower roller at a positive speed to maintain constant yarn tension between the roll feed and needles, said lower roller being provided with a high friction surface on the periphery thereof, said upper roller being floatingly mounted whereby the weight of the upper roller will exert nip pressure against the lower roller for maintaining frictional wrap around contact between the yarn strands and the lower roller, said friction surface on the lower roller being a resilient external surface to increase frictional contact between the lower roller and the yarn strands, said upper roller being a heavy roller having a smooth external surface lower roller, said upper yarn strand guide means including a plurality of equally spaced eyelets disposed above the upper roller and spaced laterally of the rotational axis thereof for guiding the individual yarn strands downwardly into tangential engagement with the upper roller and into the laterally facing nip between the upper and lower rollers, said lower yarn strand guide means including a plurality of equally spaced eyelets disposed below the lower roller for receiving individual yarn strands from the lower roller, said lower eyelets being positioned generally in vertical alignment with the rotational axes of the upper and lower rollers whereby the yarn strands engage approximately one-half of the resilient peripheral surface of the lower roller.

9. The structure as defined in claim 8 wherein said upper and lower eyelets are mounted on strips adapted to be adjustably supported on a central vertical post providing a support for the creel ring on the circular knitting machine.

* * * * *